US011617489B2

(12) United States Patent
He et al.

(10) Patent No.: US 11,617,489 B2
(45) Date of Patent: Apr. 4, 2023

(54) CLEANING TOOL WITH A SPIN-DRYING BUCKET

(71) Applicant: Ningbo Deruntang Intelligent Technology Co., Ltd., Ningbo (CN)

(72) Inventors: Min He, Ningbo (CN); Jian Wu, Ningbo (CN)

(73) Assignee: Ningbo Deruntang Intelligent Technology Co., Ltd., Ningbo (CN)

( * ) Notice: Subject to any disclaimer, the term of this patent is extended or adjusted under 35 U.S.C. 154(b) by 586 days.

(21) Appl. No.: 16/808,118

(22) Filed: Mar. 3, 2020

(65) Prior Publication Data

US 2021/0076895 A1 Mar. 18, 2021

(30) Foreign Application Priority Data

Sep. 13, 2019 (CN) ..... 201910867616.1

(51) Int. Cl.
*A47L 13/142* (2006.01)
*A47L 13/26* (2006.01)

(52) U.S. Cl.
CPC ..... *A47L 13/142* (2013.01); *A47L 13/26* (2013.01)

(58) Field of Classification Search
CPC .. A47L 13/26; A47L 13/58–59; A47L 13/142; A47L 13/502
USPC ..... 15/119.1, 229.1, 229.2, 263
See application file for complete search history.

(56) References Cited

U.S. PATENT DOCUMENTS

2007/0039117 A1* 2/2007 Palmer ..... A47L 13/58 15/260
2017/0065144 A1* 3/2017 Huang ..... A47L 13/58
2018/0028040 A1* 2/2018 Delangue ..... B08B 3/02

* cited by examiner

*Primary Examiner* — Michael D Jennings
*Assistant Examiner* — Aaron R McConnell
(74) *Attorney, Agent, or Firm* — Wang Law Firm, Inc.

(57) ABSTRACT

A cleaning tool with a spin-drying bucket, comprising a hand-operated rotary mop (2) and a bucket (1), the hand-operated rotary mop (2) comprises an upper rod (21) and a lower rod (22) disposed in a nested arrangement, the upper rod (21) extends telescopically from the lower rod (22), and the lower rod (22) rotates relative to the upper rod (21), a driving mechanism disposed between the upper rod (21) and the lower rod (22) converts a telescopic motion of the upper rod (21) into a rotary motion of the lower rod (22), the lower rod (22) has a mop head (23) with a wiper disposed at a bottom of the lower rod (22); a transmission shaft (3), used for connecting to the mop head (23), is disposed in the bucket (1), a water spray mechanism (5) having a squeezing component (52) for spraying water to the wiper, is disposed in the bucket (1), when the mop head (23) is connected to the transmission shaft (3), the rotation of the lower rod (22) drives the transmission shaft (3), the mop head (23), and the squeezing component (52) of the water spray mechanism (5) to rotate together around a same axis and/or at a same speed.

21 Claims, 10 Drawing Sheets

CLEANING TOOL WITH A SPIN-DRYING BUCKET

FIELD OF THE INVENTION

The present invention relates to a cleaning tool, and in particular to a cleaning tool with a spin-drying bucket, by which a flat mop is cleaned and dewatered.

DESCRIPTION OF THE PRIOR ART

A rotary mop has advantages of convenient cleaning and dewatering, especially the cleaning effect that can be achieved by a semi-wet mop, and includes a mop bucket and a mop rod. At the lower end of the mop rod, there is a mop head on which a wiper may be provided. The mop rod includes an inner rod and an outer rod that are socketed to each other. A driving mechanism capable of converting the telescopic motion of the outer rod into the rotary motion of the inner rod is provided between the inner rod and the outer rod. The mop bucket is provided therein with a rotatable cleaning plate located below the water level and a dewatering basket located above the water level. When cleaning the mop, it is beneficial for the rotation of the mop head to drive the cleaning plate in the mop bucket to rotate, in order to realize the agitation and cleaning of the mop head in the water. When dewatering the mop, it is beneficial for the rotation of the mop head to drive the dewatering basket in the mop bucket to rotate, in order to realize centrifugal dewatering. For example, the use of the mop disclosed in a Chinese Patent CN201755206U, entitled "HAND-OPERATED ROTARY MOP", together with the dewatering bucket disclosed in a Chinese Patent CN201775610U, entitled "DEWATERING BUCKET SPECIAL FOR HAND-OPERATED ROTARY MOP", realizes the cleaning and spin-drying of the hand-operated rotary mop.

In a traditional mop bucket, cleaning and dewatering are carried out independently in two parts in a bucket, resulting in great increase in the cross-sectional area of the entire bucket. For some mop heads, they are cleaned and dewatered in a same part of the bucket, but a lifting function is required at the rotating structure. That is, during cleaning, the dewatering basket is located at a low position, at least partially below the water level; during dewatering, the dewatering basket is located at a high position, completely above the water level. Such an arrangement increases the depth of the bucket and the operation is complicated. Because cleaning and spin-drying in the existing mop buckets are not carried out at a same height in a bucket, there are two positions, i.e., a cleaning position and a spin-drying position, and the spin-drying position is above the cleaning position. As a result, the existing mop buckets cannot be miniaturized.

In view of the above stated situation, the applicant has invented a novel non-lifting cleaning and spin-drying bucket. A Chinese Patent Application CN108852204A (Patent Application No. 201710332858.1), entitled "Improved Mop Bucket", disclosed such a water-saving mop bucket including a bucket. A supporting structure that supports a mop plate is provided in the bucket. The supporting structure allows the mop plate resting thereon to rotate at a fixed height. A cleaning component and a water pump are provided in the bucket. The cleaning component is used for scraping a wiper on the bottom of the mop plate that rotates at a fixed height in the bucket. The water pump is used for spraying water to the wiper on the bottom of the mop plate that rotates at a fixed height in the bucket. The water pump is controlled by a control mechanism to spray water. The preferred supporting structure involved in the patent includes a transmission shaft and a rotary support. The transmission shaft is directly or indirectly driven to rotate, by the mop rod of the flat mop. The rotary support is provided for the connection of the mop plate. The rotary support is sleeved on the transmission shaft and can rotate around its own axis with respect to the transmission shaft. The rotation of the rotary support can drive the mop plate to rotate together. The rotary support is connected to the transmission shaft by a reduction mechanism, so that the rotation of the transmission shaft drives the rotary support to rotate at a reduced speed by the reduction mechanism. An acceleration gear mechanism is provided between the bottom of the transmission shaft and the input shaft of the water pump, which can drive the water pump to work faster. However, the preferred embodiment of the patent is overall complicated and costly.

Therefore, how to reduce the cost on the basis of realizing the foregoing functions is a technical problem to be solved.

SUMMARY OF THE INVENTION

It is an object of the present invention to provide a cleaning tool with a spin-drying bucket, which is simpler and more rational in structure, is low in cost, and can realize cleaning and spin-drying at a same position without lifting.

For achieving the above object, the cleaning tool with a spin-drying bucket comprises a hand-operated rotary mop and a bucket, wherein, the hand-operated rotary mop comprises an upper rod and a lower rod disposed in a nested arrangement, the upper rod extends telescopically from the lower rod, and the lower rod rotates relative to the upper rod, a driving disposed between the upper rod and the lower rod converts a telescopic motion of the upper rod into a rotary motion of the lower rod, the lower rod has a mop head with a wiper disposed at a bottom of the lower rod, a transmission shaft used for connecting to the mop head, is disposed in the bucket, a water spray mechanism having a squeezing component for spraying water to the wiper, is disposed in the bucket, when the mop head is connected to the transmission shaft, the rotation of the lower rod drives the transmission shaft, the mop head, and the squeezing component of the water spray mechanism to rotate together around a same axis and/or at a same speed.

Preferably, wherein the water spray mechanism (5) is controlled by a control mechanism that adjusts the amount of water sprayed onto the wiper by the water spray mechanism, cleaning of the wiper includes two steps, the amount of water sprayed onto the wiper by the water spray mechanism in the first step is greater than the amount of the water in the second step. In this way, cleaning and spin-drying are carried out in two distinct stages. The cleaning and spin-drying effects are both great.

Rotation around a same axis and at a same speed is optimal. Of course, rotation at a same speed, not around a same axis, may be possible as long as the transmission shaft, the mop head and the squeezing component of the water spray mechanism rotate at a same speed. For example, rotation at a same speed may be that the transmission shaft and the squeezing component are driven by transmission mechanisms which operate at a same speed, while the transmission shaft and the squeezing component are not coaxial.

Preferably, the squeezing component is an impeller driven to rotate by the transmission shaft. The squeezing component is driven directly by the transmission shaft to output high-pressure water, without requiring any acceleration mechanism. Therefore, the structure is simpler. The direct driving may be the direct and hard connection of the impeller to the transmission shaft. The direct connection of the impeller to the transmission shaft without any difference in speed and the use of the impeller result in the simplest transmission mode. The water spray mechanism is an impeller pump.

Preferably a cleaning component used for cleaning the wiper on the bottom of the mop head rotating in the bucket, is disposed in the bucket.

Preferably, the cleaning component is a bristle holder with bristles, and the bristles are capable of scraping and brushing the rotating wiper to clean the wiper. In this way, dirt on the wiper can be scraped away better. The cleaning effect is better. Of course, the cleaning component may be a scraper bar or a scraper roller. The cleaning operation is carried out by scraping the wiper, which is rotating, by the scraper bar or the scraper roller.

Due to the unevenness or different thickness of the wiper on the bottom of the mop head, to avoid missing the brushing to any part of the wiper by the bristles, preferably, the lower portion of the bristle holder is swingably disposed on the housing, and an elastic mechanism is disposed between the bristle holder and the housing making the bristle holder to move upward to ensure contact between the bristles and the wiper; or, the water spray mechanism has a housing, the bristle holder is floatably disposed in the housing, and an elastic mechanism is disposed between the bristle holder and the housing making the bristle holder to move upward to ensure the sufficient contact between the bristles and the wiper. In this way, the bristles can swing in a targeted way to ensure the sufficient contact between the bristles and the wiper. Thus, the cleaning effect of the bristles is improved.

As one of the control manners, the control mechanism is a control member which controls the water intake speed of a water intake of the water spray mechanism, so as to make the water intake speed lower than the water spray speed of the water spray mechanism. Since the water intake speed is lower than the water spray speed, when water in a chamber in the water spray mechanism becomes less, the amount of water sprayed decreases. When water in the chamber is pumped out, no water will be sprayed to the wiper by the water spray end of the water spray mechanism. The wiper is spin-dried by the high-speed rotation of the mop head. There are various ways to implement the control member. The control member may be a switch mechanism that completely switches off the water supply to the water intake, or a barrier structure that slows down the water intake. For example, the control member is a filter component disposed at the water intake of the water spray mechanism, or a lid with small pores, which is disposed at the water intake of the water spray mechanism.

As a specific structure of the control member, the control member is a switch mechanism which is capable of blocking or unblocking the water intake of the water spray mechanism; when the switch mechanism is closed, the water supply to the water spray mechanism is deactivated or reduced, so as to ensure the amount of water sprayed to the wiper by the water spray mechanism gradually decreases. By the switch mechanism, the amount of water sprayed to the wiper by the water spray end of the water spray mechanism in unit time is controlled. Specifically, when in use, since the water intake that supplies water to the water spray mechanism is blocked by the switch mechanism, water cannot flow into the chamber in the water spray mechanism. When water in the chamber in the water spray mechanism becomes less, the amount of water sprayed decreases. When water in the chamber is pumped out, no water will be sprayed to the wiper by the water spray end of the water spray mechanism. The wiper is spin-dried by the high-speed rotation of the mop head.

Preferably, a switch component extended into the housing of the water spray mechanism and movable up and down, and an elastic member disposed inside the housing resisting against the switch component to make the switch component moving upward, the switch component is disposed beside the transmission shaft, when the mop head is connected to the transmission shaft, the switch component moves downward under pressure from the mop head, accordingly, the bottom of the switch component blocks the water intake of the water spray mechanism; and when the mop head is separated from the transmission shaft, the switch component moves upward by the elastic member and the bottom of the switch component unblocks the water intake of the water spray mechanism.

Preferably, a circular contact component rolling against the wiper disposed on the top of the switch mechanism. This design ensures that the rotation of the mop head is easier. The contact component may be an idler wheel or a steel ball or a cylindrical roller.

For ease of assembling and cleaning, preferably, the bucket has a chamber at the bottom inside the bucket, the housing of the water spray mechanism is detachably disposed in the chamber.

Preferably, a rotary lock mechanism is disposed between the housing and the chamber; when the housing rotates along the rotation direction of the mop head, the housing locks with the chamber, and when the housing rotates along a direction reverse to the rotation direction of the mop head, the housing unlocks with and the chamber. By the rotary lock mechanism, the water spray mechanism is detachably connected to the cleaning bucket, so that it is more convenient to detach the water spray mechanism. Furthermore, during the connection by the rotary lock mechanisms, the rotation direction of the water spray mechanism is consistent with the rotation direction of the mop head. This can avoid disconnecting the water spray mechanism from the cleaning bucket during the rotation of the mop to influence the cleaning of the mop. Therefore, the connection of the water spray mechanism to the cleaning bucket is more firm.

Preferably, the housing of the water spray mechanism consists of an upper housing and a lower housing connecting with each other forming a chamber inside the housing, the lower housing has multiple water drainage holes. Such design facilitates the assembling operation. The lower housing has multiple water drainage holes from which the housing can be flushed conveniently. When the housing is taken out, the housing is flushed with water. Dirt can be removed with water from the water drainage holes. Therefore, the cleaning is more complete. A cover is disposed inside the lower housing covering the squeezing component of the water spray mechanism, the inner space of the cover is communicated with the chamber of the housing, the cover has a water passage at the periphery of the cover, and the housing has a transverse water outlet passage at the top of the housing which communicated with the water passage, several water spray holes are formed on the wall of the water outlet passage which face the wiper on the mop head. The design of the cover facilitates the water delivery. Since the squeezing component is constrained by the cover, the rotation of the squeezing component can ensure that water fully enters the water outlet passage by the water passage and is finally sprayed by the several water spray holes after flowing through only one water outlet passage. The loss of energy is low.

Preferably, the water outlet passage has an inlet at the bottom of the water outlet passage, a pipe is disposed between the inlet and the water passage, and a baffle located above the inlet is disposed inside the water outlet passage. Under the design of the baffle, the high-pressure water flowing from the inlet end is stopped. Thus, the water flow is evenly distributed in the water outlet passage. In the case of no baffle, the water flow will be sprayed basically from the water spray holes closest to the inlet end. The amount of water sprayed from the other water spray holes will be small. As a result, the spraying of water is uneven and the water distribution on the wiper is uneven.

For ease of molding, a water delivery groove opening upward is formed on the top of the upper housing, a top cap covering the top of the water delivery groove, is disposed on the upper housing, the space between the water delivery groove and the top cap forms the water outlet passage, and the water spray holes are formed on the top cap.

Preferably, a water drainage groove opening upward is further formed on the top of the upper housing, the water drainage groove is communicated with the chamber of the water spray mechanism. The top cap also covers the water drainage groove. Through the water drainage groove, it is more convenient to drain foul water in the housing.

To ensure good spraying effect, the upper portion of the housing of the water spray mechanism is higher than the inner bottom surface of the bucket. Furthermore, a highest water level indicator is disposed in a part of the housing of the water spray mechanism higher than the inner bottom surface of the bucket. The height of the highest water level indicator is lower than the water spray end of the water spray mechanism. If the water level is higher than the water spray end of the water spray mechanism, water cannot be sprayed to the wiper. By the highest water level indicator, the user is reminded of the injection amount of water during water injection. The design is more user-friendly.

To separate the clean water from the foul water, preferably, a detachable water tank is mounted on the bucket, the water tank has a water outlet and a water inlet, the water outlet is sealed against the water intake of the water spray mechanism. Under such design, the clean water used for cleaning the wiper on the mop head is completely separated from the foul water left after the cleaning. This ensures that the wiper is cleaned always with the clean water during the cleaning. Therefore, the mop can be cleaned better. By the arrangement that separates the clean water from the foul water, the housing of the water spray mechanism may be directly fixed in the bucket and sealed properly, because it is unnecessary to clean the housing.

A fixed shaft is fixed in the housing of the water spray mechanism. The transmission shaft is sleeved at the top end of the fixed shaft. The squeezing component is an impeller having an impeller shaft sleeved on the fixed shaft by a bearing. The transmission shaft is connected to the impeller shaft. The connection is hard connection. It may be threaded connection or connection by welding.

Preferably, the squeezing component is an impeller, and an impeller shaft extending out of the housing of the water spray mechanism from the upper portion of the impeller; a fixed shaft is disposed in the housing of the water spray mechanism, the transmission shaft is sleeved at the top of the fixed shaft, and the impeller shaft is sleeved on the fixed shaft through a bearing, the transmission shaft is connected to the impeller shaft. The transmission shaft and the impeller shaft are supported by a rolling shaft, so that the bottom of the impeller is not in contact with the inner wall of the water spray mechanism. This greatly reduces the friction to the inner wall of the water spray mechanism during the rotation of the impeller. The kinetic energy loss becomes low and the impeller shaft rotates faster. This shortens the cleaning and spin-drying process of the mop. On the other hand, due to the connection of the impeller shaft to the fixed shaft by the bearing, the friction to the impeller shaft from the fixed shaft during its rotation is low.

To realize easy rotation of the transmission shaft, preferably, a rolling member is disposed on the top of the fixed shaft, so as to support the transmission shaft and the mop head connected to the transmission shaft. As an alternative solution, a ball is disposed on the top of the inner wall of the transmission shaft or on the top of the support rod.

Preferably, the bristle holder is located on a side of the transmission shaft and arranged from the center to the outside of the housing, the bristles have an inner end close to the transmission shaft in the radial direction and an outer end away from the transmission shaft in the radial direction, and the height ($h_1$) of the top surface of the outer end of the bristles is higher than the height ($h_2$) of the top surface of the inner end of the bristles.

Preferably, a recess is formed on the housing of the water spray mechanism, the water intake runs through the bottom of the recess, and the filter component is disposed inside the recess and can be taken out from the recess. This structure is convenient for picking or placing the filter component.

Preferably, several spacers protrudes from the annular bottom surface of the recess, distributed in the radial direction and along on the circumference at intervals, a water flow channel communicated with the water intake is formed between two adjacent spacers, and the filter component is placed on the spacers. The spacers raise the filter component. Water, filtered by the filter component, can be quickly delivered to the water intake by the water flow channel.

For achieving the above object, another cleaning tool with a spin-drying bucket is provided, which comprises: a hand-operated rotary mop and a bucket, wherein, the hand-operated rotary mop comprises an upper rod and a lower rod disposed in a nested arrangement, the upper rod extends telescopically from the lower rod, and the lower rod rotates relative to the upper rod, a driving mechanism disposed between the upper rod and the lower rod converts a telescopic motion of the upper rod into a rotary motion of the lower rod, the lower rod has a mop head with a wiper disposed at a bottom of the lower rod, a transmission shaft, used for connecting to the mop head, is disposed in the bucket, a water spray mechanism having a squeezing component for spraying water to the wiper, is disposed in the bucket, when the mop head is connected to the transmission shaft, the rotation of the lower rod drives the transmission shaft, the mop head, and the squeezing component of the water spray mechanism to rotate together, the water spray mechanism is controlled by a control mechanism that adjusts the amount of water sprayed onto the wiper by the water spray mechanism, cleaning of the wiper includes two steps, the amount of water sprayed onto the wiper by the water spray mechanism in the first step is greater than the amount of the water in the second step.

Preferably, the control mechanism is a control member which controls the water intake speed of a water intake of the water spray mechanism, so as to make the water intake speed lower than the water spray speed of the water spray mechanism. The control member is a switch mechanism which is capable of blocking or unblocking the water intake of the water spray mechanism; when the switch mechanism is closed, the water supply to the water spray mechanism is deactivated or reduced, so as to ensure the amount of water sprayed to the wiper by the water spray mechanism gradually decreases. The control member is a filter component disposed at the water intake of the water spray mechanism, or a lid with small pores, which is disposed at the water intake of the water spray mechanism.

Compared with the prior art, the present invention has the following advantages: in a state in which the mop head is connected to the transmission shaft, the rotation of the lower rod drives the transmission shaft, the mop head, and the squeezing component of the water spray mechanism to rotate together around a same axis and/or at a same speed. It is unnecessary to additionally sleeve, on the transmission shaft, a rotary support that drives the mop head to rotate. No reduction mechanism is required. Meanwhile, since the squeezing component is directly driven by the rotation of the transmission shaft, it is unnecessary to provide an acceleration mechanism between the squeezing component and the transmission shaft. Therefore, the structure of the cleaning tool is greatly simplified and the cost is greatly reduced. By tests, the simplified structure can provide great spraying and brushing effect.

The water spray mechanism is controlled by the control mechanism in terms of the amount of water sprayed to the wiper by the water spray end of the water spray mechanism in unit time. The cleaning operation includes two time periods, i.e., a first time period and a second time period. The amount of water sprayed to the wiper by the water spray mechanism in the first time period is greater than that in the second time period. At the beginning, a great amount of water is sprayed, and the amount of water sprayed to the wiper is greater than the amount of water spin-dried. This process is the cleaning process. Then, the amount of water gradually decreases, and the amount of water spin-dried is greater than the amount of water sprayed to the wiper. This process is the spin-drying process. Since cleaning and drying are carried out in a same position, it is unnecessary to provide a cleaning position and a spin-spraying position in the bucket, respectively. Therefore, the volume of the entire bucket is greatly reduced, when compared to the traditional mop heads.

DETAILED DESCRIPTION OF THE PREFERRED EMBODIMENT

Figure 1:
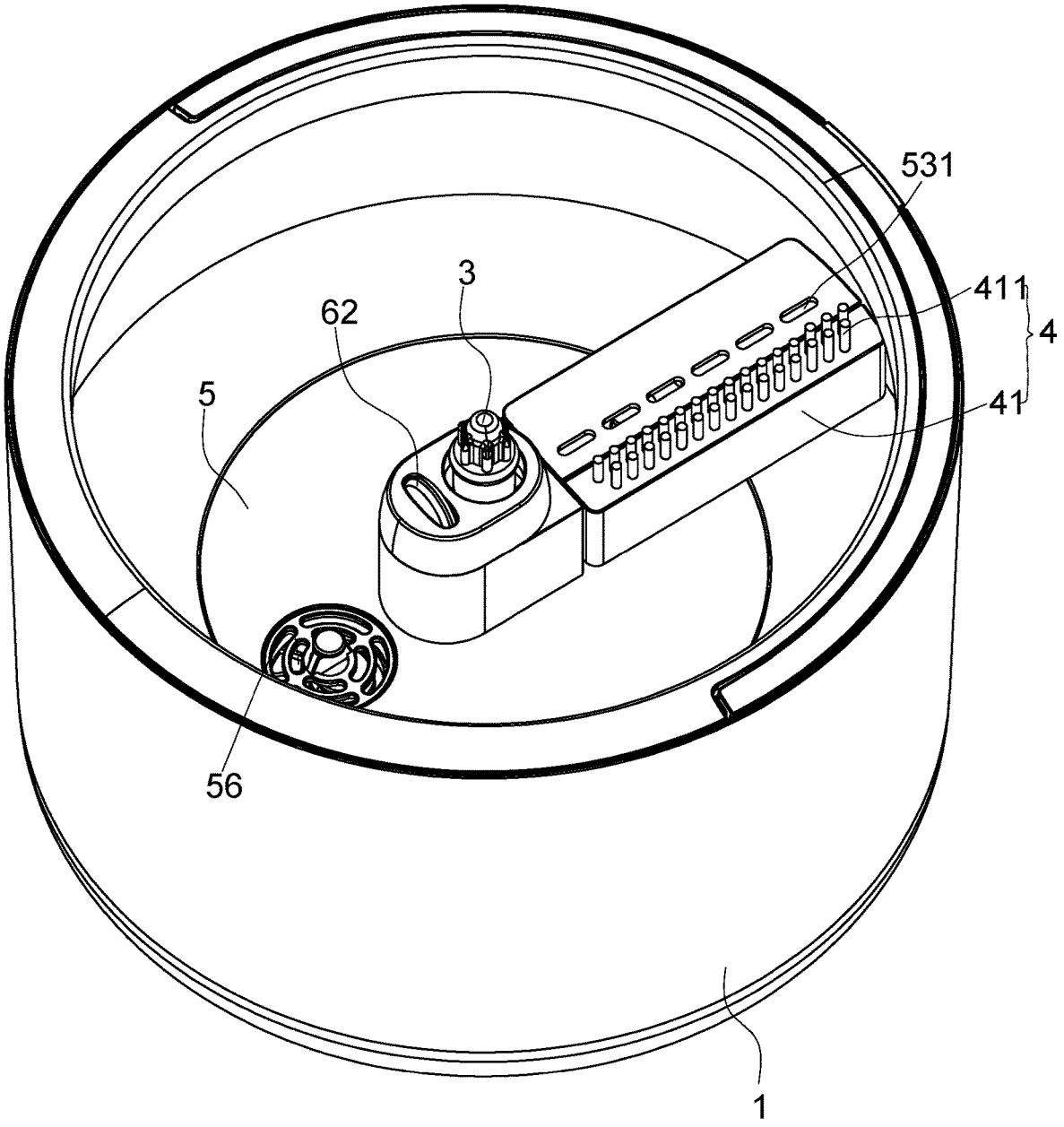
FIG. 1 is a perspective view of a cleaning tool with a mop removed according to a first embodiment of the present invention.
Figure 2:
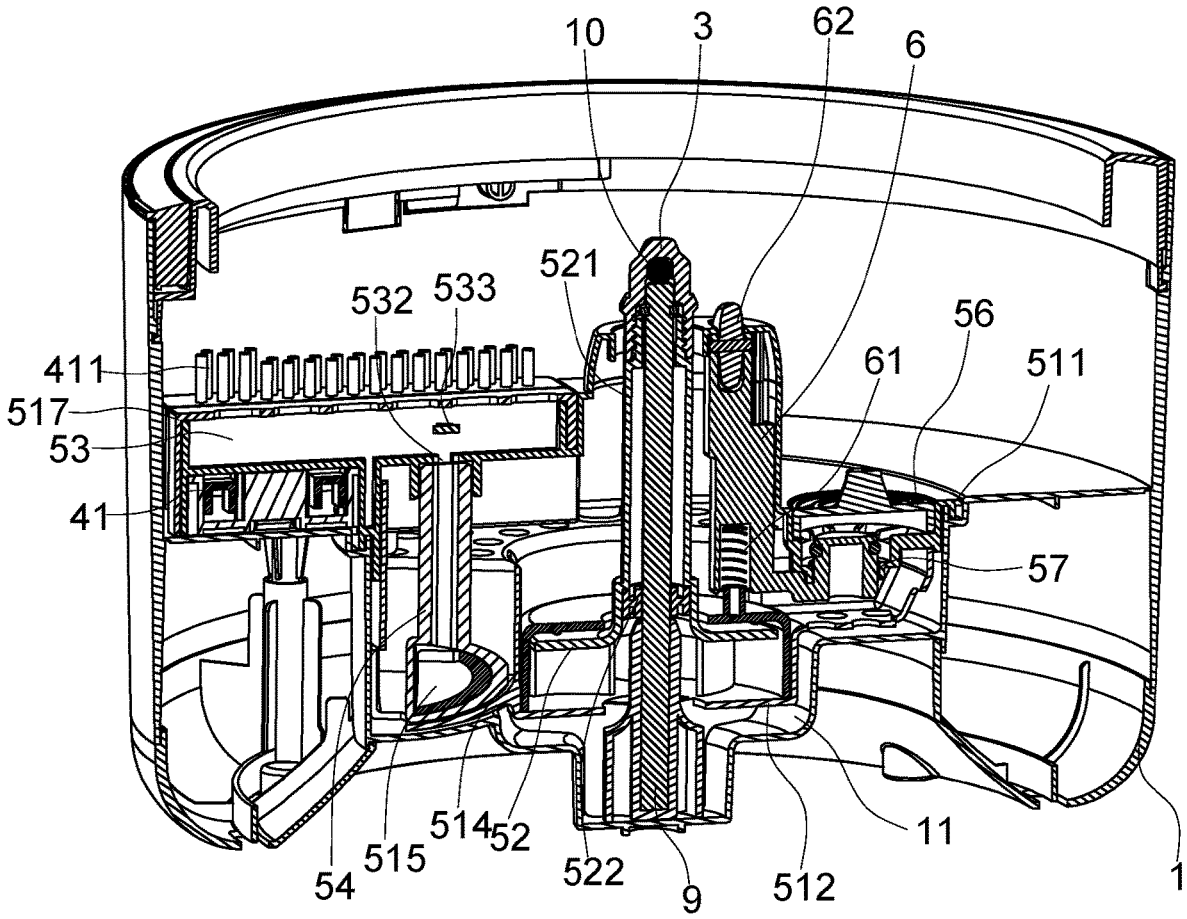
FIG. 2 is a sectional view of the cleaning tool (in a normal state) with the mop removed according to the first embodiment.
Figure 3:
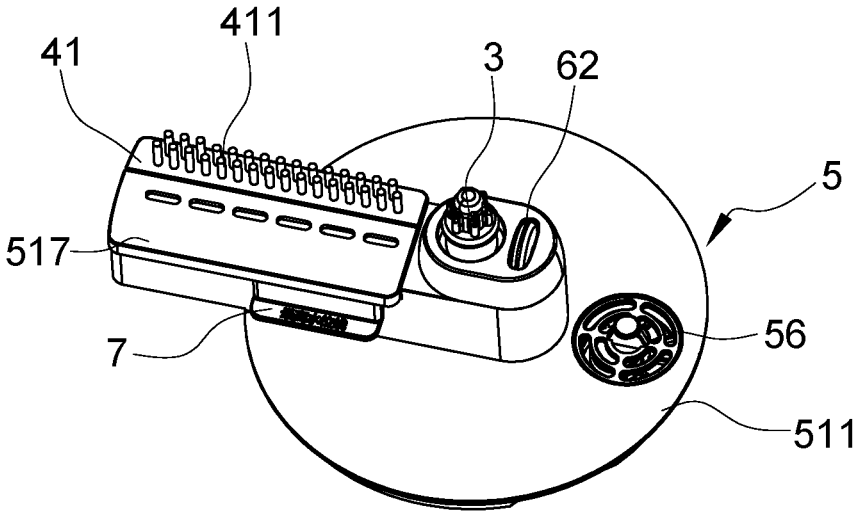
FIG. 3 is a partially exploded view of FIG. 1.
Figure 3:
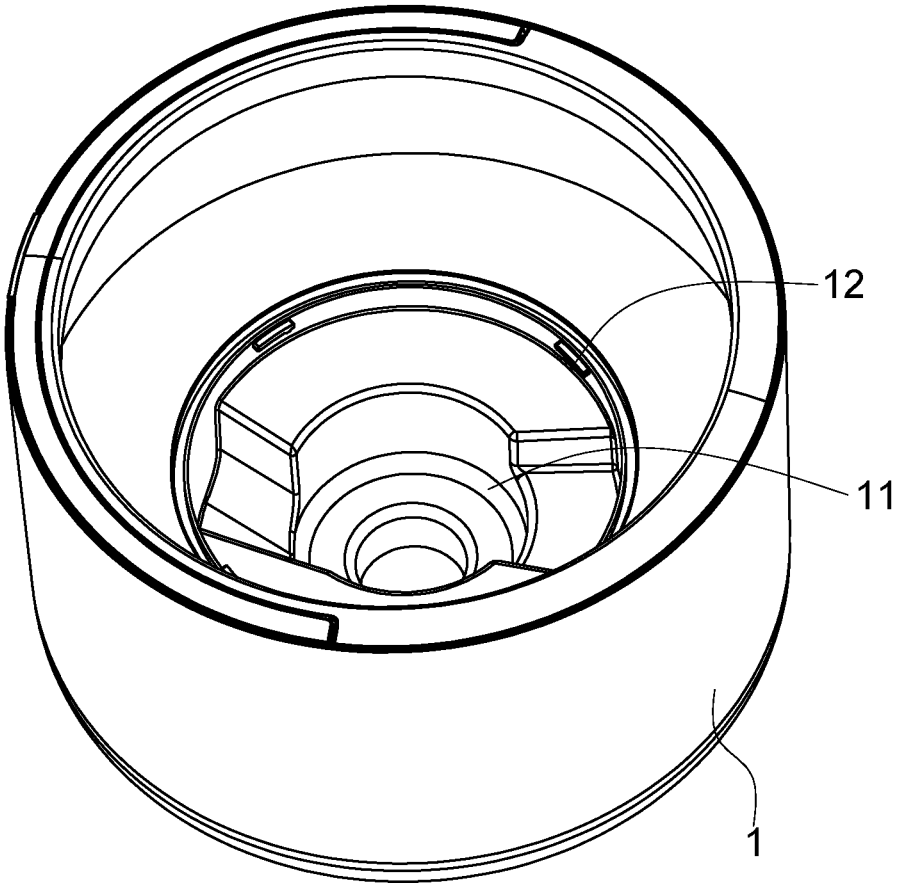
Figure 4:
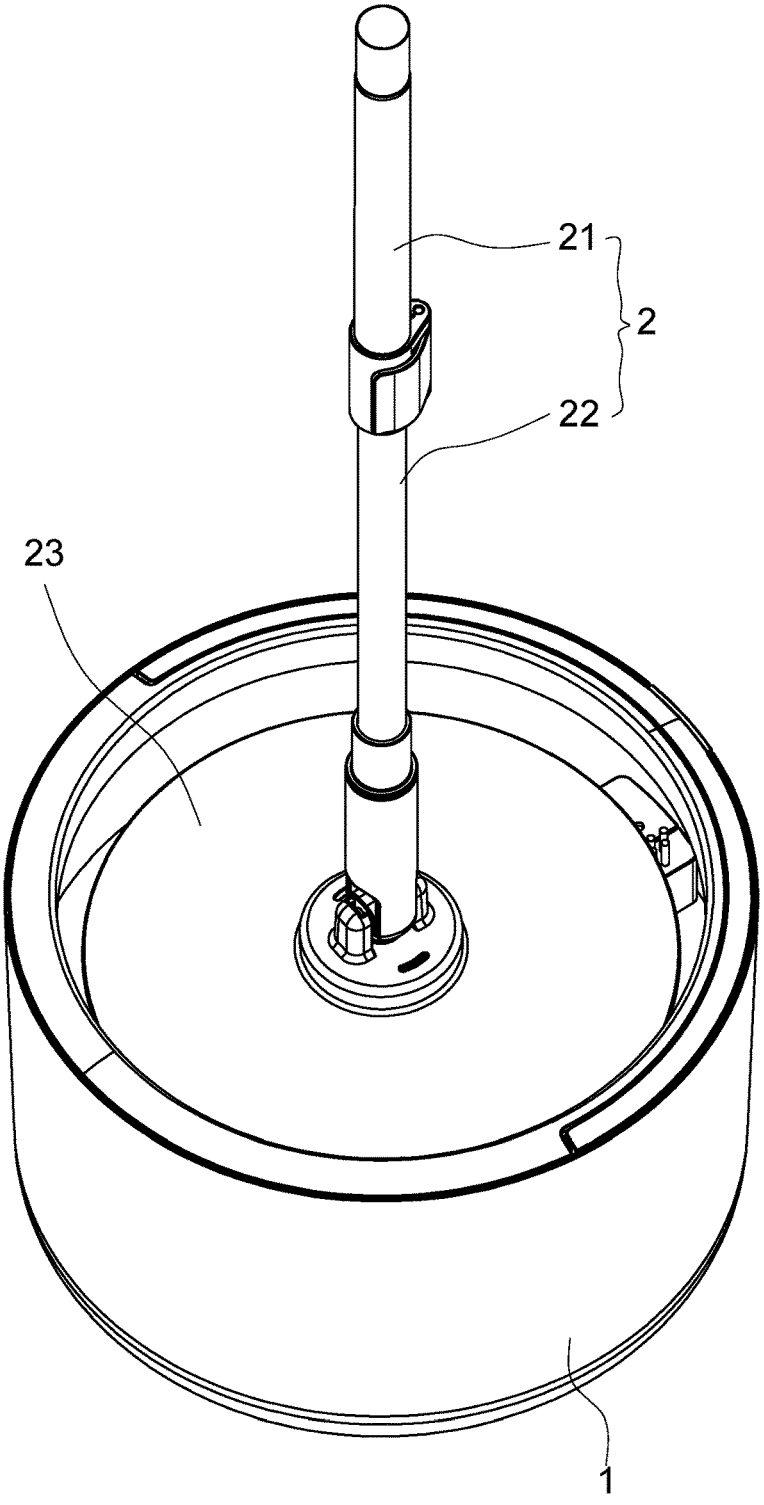
FIG. 4 is a perspective view of the cleaning tool according to the first embodiment (in a work state)
Figure 5:
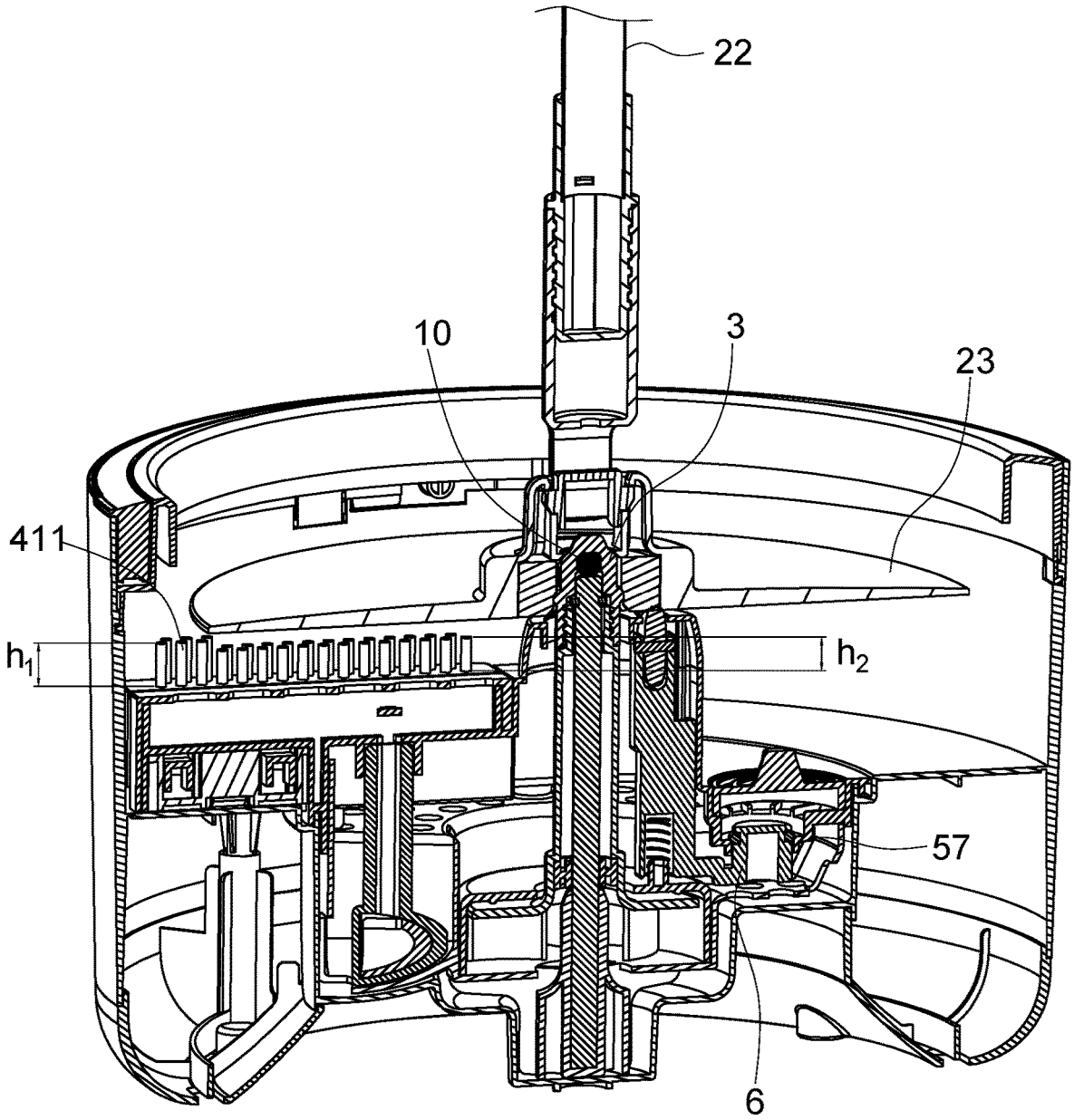
FIG. 5 is a sectional view of the cleaning tool according to the first embodiment (in a work state)
Figure 6:
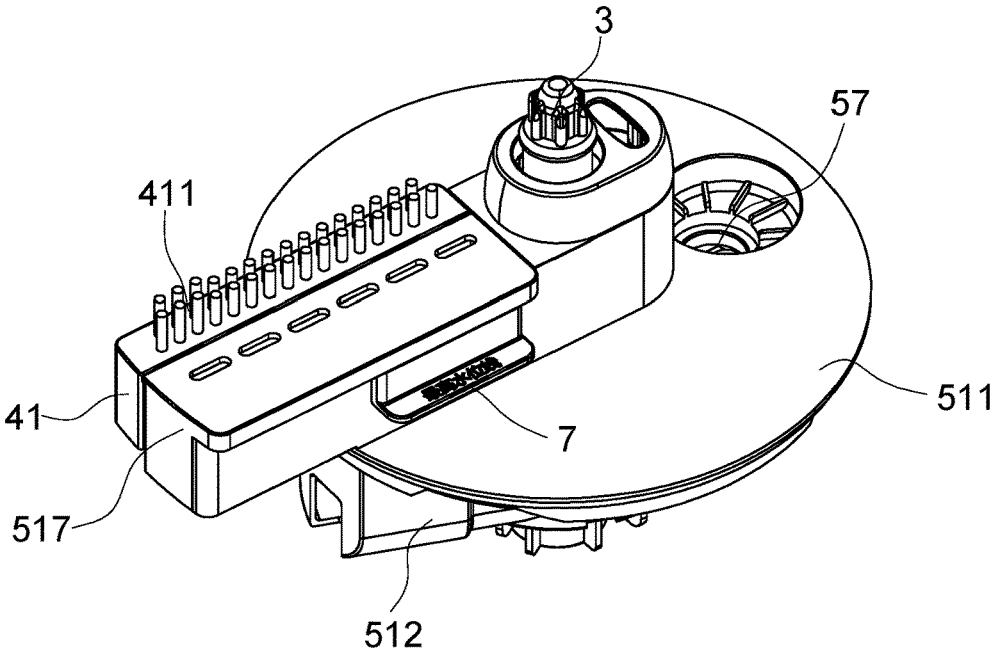
FIG. 6 is a first perspective view of the water spray mechanism according to the first embodiment.
Figure 7:
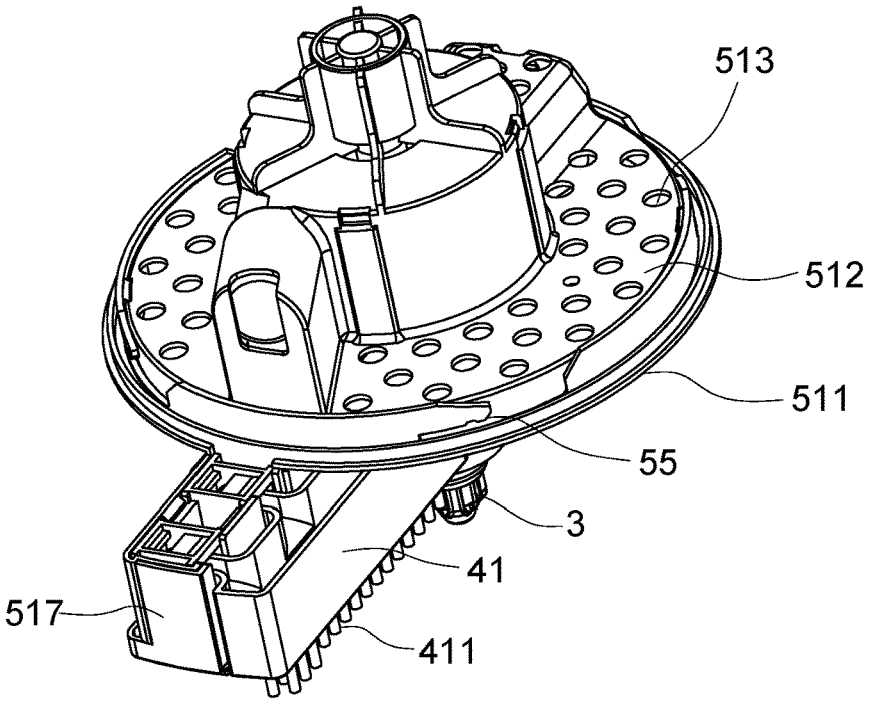
FIG. 7 is a second perspective view of the water spray mechanism according to the first embodiment.
Figure 8:
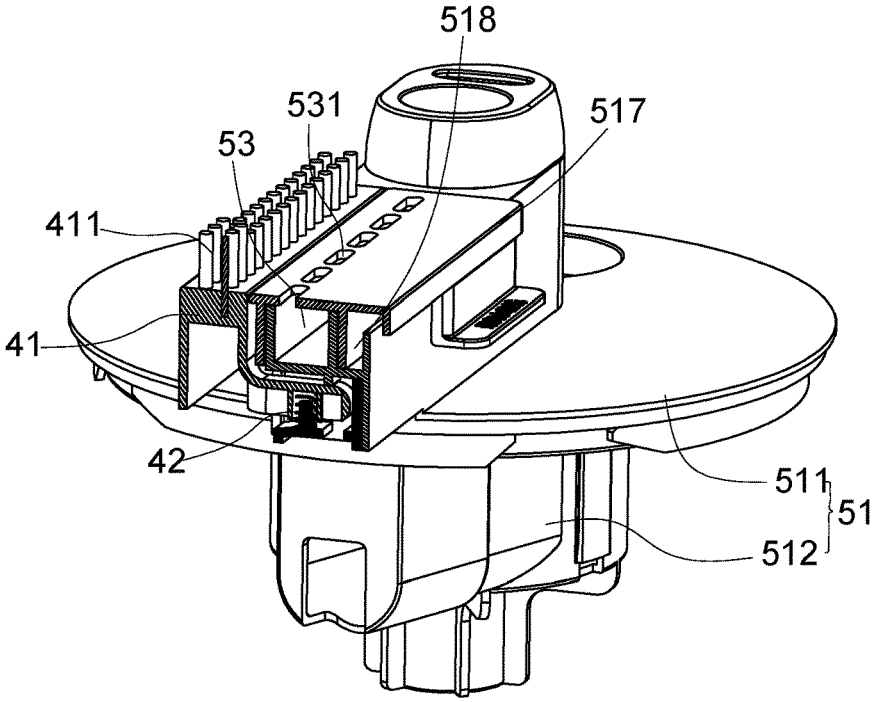
FIG. 8 is a partially sectional view of the water spray mechanism according to the first embodiment.
Figure 9:
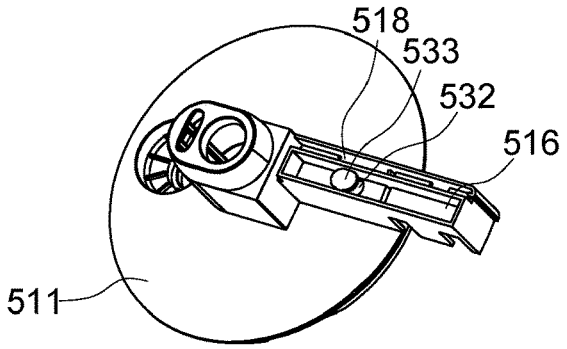
FIG. 9 is a perspective view of the upper housing according to the first embodiment.
Figure 10:
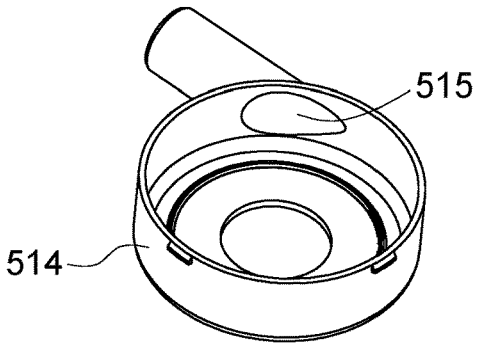
FIG. 10 is a perspective view of the cover according to the first embodiment.
Figure 11:
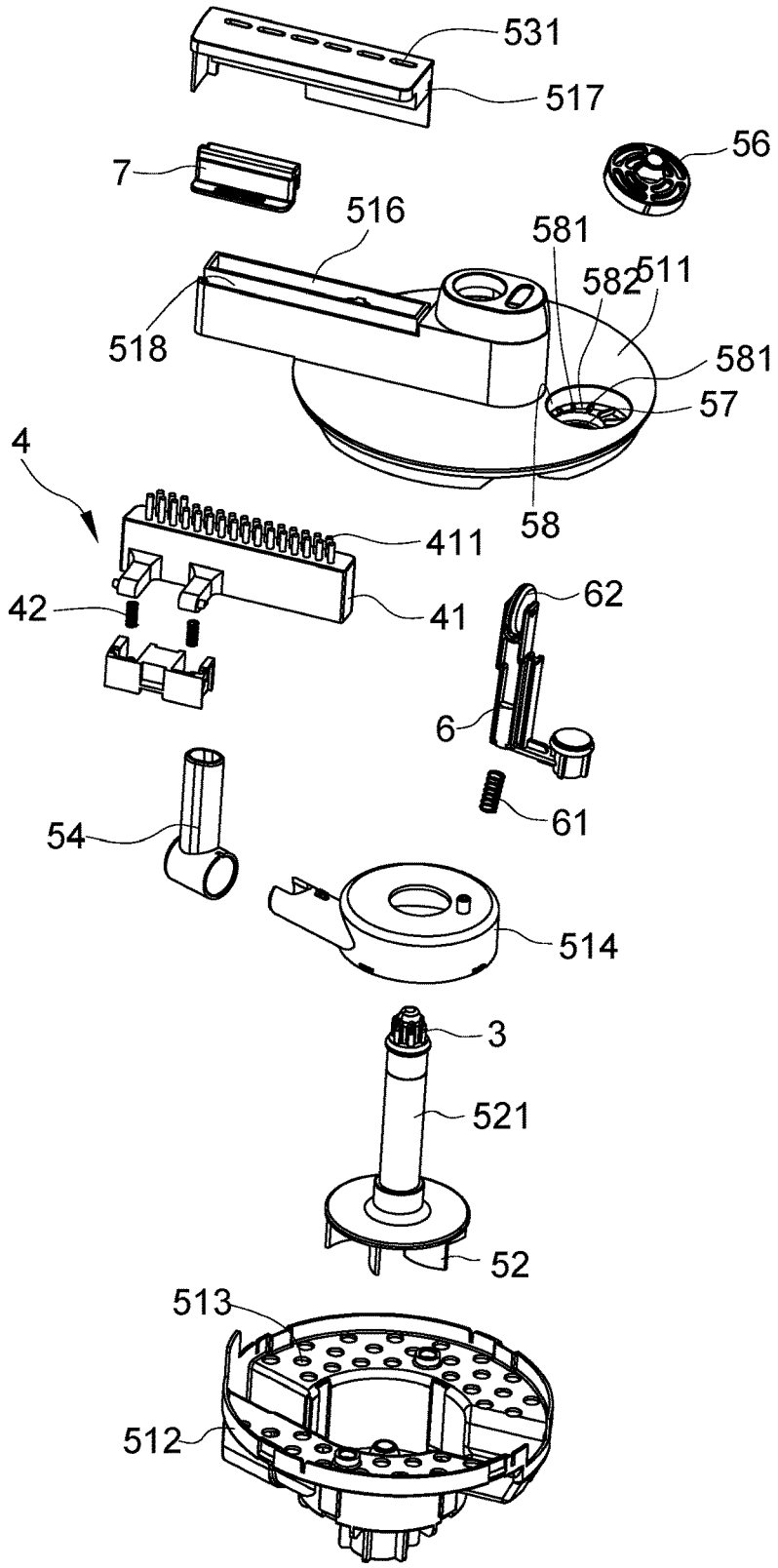
FIG. 11 is an exploded view of the water spray mechanism according to the first embodiment.

To enable a further understanding of the present invention content of the invention herein, refer to the detailed description of the invention and the accompanying drawings below:

FIG. 1 to FIG. 11 show a first embodiment of the present invention.

The cleaning tool with a spin-drying bucket includes a hand-operated rotary mop 2 and a bucket 1. the hand-operated rotary mop 2 comprises an upper rod 21 and a lower rod 22 disposed in a nested arrangement, the upper rod 21 extends telescopically from the lower rod 22, and the lower rod 22 rotates relative to the upper rod 21, a driving mechanism disposed between the upper rod 21 and the lower rod 22 converts a telescopic motion of the upper rod 21 into a rotary motion of the lower rod 22, the lower rod 22 has a mop head 23 with a wiper disposed at a bottom of the lower rod 22. The wiper may be cloth or the like. The mop head 23 is a flat mop head. The flat mop head may be discoid or rectangular. A transmission shaft 3, used for connecting to the mop head 23, is disposed in the bucket 1.

A cleaning component 4 and a water spray mechanism 5 are disposed in the bucket 1. In a state in which the mop head 23 is connected to the transmission shaft 3 (the connection generally means that the mop head 23 is sleeved on the transmission shaft and driven by rib-groove fit), the rotation of the lower rod 22 drives the transmission shaft 3, the mop head 23, and a squeezing component 52 of the water spray mechanism 5 to rotate together around a same axis. The water spray mechanism 5 may be an impeller pump, accordingly the squeezing component 52 is a blade wheel. The squeezing component 52 mainly functions to pump water to around water spray holes 531. The cleaning component 4 is used for cleaning the wiper on the bottom of the mop head 23 that rotates in the bucket 1. The cleaning component 4 is disposed radially by using the axis of the transmission shaft 2 as a circle center. The cleaning component 4 is overlapped, from the inside to outside, with the wiper in the radial direction on a side of the center of the mop head 23.

The cleaning component 4 is a bristle holder 41 with bristles 411, and the bristles 411 are capable of scraping and brushing the rotating wiper to clean the wiper. In this way, dirt on the wiper can be scraped away better. The cleaning effect is better. The lower portion of the bristle holder 41 is swingably disposed on the housing 51, and an elastic mechanism 42 is disposed between the bristle holder 41 and the housing 51 making the bristle holder 41 to move upward to ensure contact between the bristles 411 and the wiper. The bristle holder 41 is floatably disposed in the housing 51, and an elastic mechanism is disposed between the bristle holder 41 and the housing 51 making the bristle holder 41 to move upward to ensure the sufficient contact between the bristles 411 and the wiper.

Additionally, the bristle holder 41 is located on a side of the transmission shaft 3 and arranged from the center to the outside of the housing 51, the bristles 411 have an inner end close to the transmission shaft 3 in the radial direction and an outer end away from the transmission shaft 3 in the radial direction, and the height $h_1$ of the top surface of the outer end of the bristles 411 is higher than the height $h_2$ of the top surface of the inner end of the bristles 411.

The squeezing component 52 of the water spray mechanism 5 is directly driven by the rotation of the transmission shaft 3. The squeezing component 52 in this embodiment is an impeller, which is accordingly directly driven to rotate by the transmission shaft 3, and the water spray mechanism 5 is controlled by a control mechanism in terms of the amount of water sprayed to the wiper by a water spray end of the water spray mechanism 5 in unit time. A fixed shaft 9 is disposed in the housing 51 of the water spray mechanism 5, the transmission shaft 3 is sleeved at the top of the fixed shaft 9. The impeller shaft 521 on the squeezing component 52 of the water spray mechanism 5 is sleeved on the fixed shaft 9 by a bearing 522. The transmission shaft 3 is connected to the impeller shaft 521 by threads. A rolling member 10 is disposed on the top of the fixed shaft 9, so as to support the transmission shaft 3 and the mop head 23 connected to the transmission shaft 3.

The cleaning process includes two steps, i.e., a first step and a second step. The amount of water sprayed onto the wiper by the water spray mechanism in the first step is greater than the amount of the water in the second step. The control mechanism is a control member which controls the water intake speed of a water intake 57 of the water spray mechanism 5, so as to make the water intake speed lower than the water spray speed of the water spray mechanism 5. In this embodiment, the control member is a switch mechanism which is capable of blocking or unblocking the water intake of the water spray mechanism 5; when the switch mechanism is closed, the water supply to the water spray mechanism 5 is deactivated or reduced, so as to ensure the amount of water sprayed to the wiper by the water spray mechanism gradually decreases.

The control member is a filter component 56 disposed at the water intake 57 of the water spray mechanism 5, or a lid with small pores, which is disposed at the water intake 57 of the water spray mechanism 5. This can be easily understood and will not be shown in the drawings.

In detail, the switch mechanism includes a switch component 6 extended into the housing 51 of the water spray mechanism 5 and that movable up and down, and the switch component is disposed beside the transmission shaft 3. A contact component 62, which is in rolling against the wiper disposed on the top of the switch mechanism. The contact component 62 is an idler wheel. An elastic member 61 disposed inside the housing 51 resisting against the switch component 6 to make the switch component 6 moving upward. when the mop head 23 is connected to the transmission shaft 3, the switch component 6 moves downward under pressure from the mop head 23, accordingly, the bottom of the switch component 6 blocks the water intake 57 of the water spray mechanism 5; and when the mop head 23 is separated from the transmission shaft 3, the switch component 6 moves upward by the elastic member 61 and the bottom of the switch component 6 unblocks the water intake of the water spray mechanism.

The bucket 1 has a chamber 11 at the bottom inside the bucket 1, the housing 51 of the water spray mechanism 5 is detachably disposed in the chamber 11. A rotary lock mechanism is disposed between the housing 51 and the chamber 11; when the housing 51 rotates along the rotation direction of the mop head 23, the housing 51 locks with the chamber 11, and when the housing 51 rotates along a direction reverse to the rotation direction of the mop head 23, the housing 51 unlocks with and the chamber 11. A neck 55 is formed on the housing 51, and a block 12 matched with the neck 55 is disposed on the inner wall of the chamber 11. The housing 51 of the water spray mechanism consists of an upper housing 511 and a lower housing 512 connecting with each other forming a chamber inside the housing 51, the lower housing 512 has multiple water drainage holes 513. A cover 514 is disposed inside the lower housing 512 covering the squeezing component 52 of the water spray mechanism 5, the inner space of the cover 514 is communicated with the chamber of the housing 51. The cover 514 has a water passage 515 at the periphery of the cover 514, and the housing 51 has a transverse water outlet passage 53 at the top of the housing 51 which communicated with the water passage 515, several water spray holes 531 are formed on the wall of the water outlet passage 53 which face the wiper on the mop head 23.

The water outlet passage 53 has an inlet 532 at the bottom of the water outlet passage 53, a pipe 54 is disposed between the inlet 532 and the water passage 515, and a baffle 533 located above the inlet 532 is disposed inside the water outlet passage 53. A water delivery groove 516 opening upward is formed on the top of the upper housing 511. A top cap 517, which shields the upper opening of the water delivery groove 516, is disposed on the upper housing 511, in order to form the water outlet passage 53 between the water delivery groove 516 and the top cap 517. The water spray holes 531 are formed on the top cap 517.

A water drainage groove 518 is further formed on the top of the upper housing 511. The water drainage groove 518 is communicated with the chamber of the water spray mechanism 5. The top cap 517 also shields the water drainage groove 518.

The upper portion of the housing 51 of the water spray mechanism 5 is higher than the inner bottom surface of the bucket 1. Furthermore, a highest water level indicator 7 is disposed in a part of the housing 51 of the water spray mechanism 5 higher than the inner bottom surface of the bucket 1. The height of the highest water level indicator 7 is lower than the water spray end of the water spray mechanism 5.

The working principle and process of the cleaning tool will be described below.

Cleaning and drying: water is injected in the bucket 1 until the water level reaches the highest water level indicator 7, in a state in which the mop head 23 is not connected to the transmission shaft 3, the switch component 6 is kept in moving upward by the elastic member 61 to unblock the water intake 57 of the water spray mechanism 5, and the clean water flows into the chamber of the water spray mechanism 5 from the water intake 57. Then, the mop head 23 is connected to the transmission shaft 3, the switch component 6 moves downward when being pressed down by the mop head 23, so that the lower end of the switch component 6 blocks the water intake 57 of the water spray mechanism 5. No or little water is supplied to the water spray mechanism 5. The mop rod is operated. The rotation of the lower rod 22 drives the transmission shaft 3 and the mop head 23 to rotate synchronously. The transmission shaft 3 drives the squeezing component 52 in the water spray mechanism 5 to rotate. Water from the squeezing component 52 flows to the water outlet passage 53 via the water passage 515 and the pipe 54, and is finally sprayed to the wiper from the water spray holes 531. During the whole process, no or little water is supplied to the water spray mechanism 5. Water in the water spray mechanism becomes less. At the beginning, a great amount of water is sprayed, and the amount of water sprayed to the wiper is greater than the amount of water spin-dried. This process is the cleaning process. Then, the amount of water gradually decreases. When water in the chamber of the water spray mechanism 5 is used up or basically used up, the water spray mechanism 5 rotates in idle. No or little water is sprayed. In this case, the amount of water spin-dried is greater than the amount of water sprayed to the wiper. This process is the spin-drying process. Since cleaning and drying are carried out in a same position, it is unnecessary to provide a cleaning position and a spin-spraying position in the bucket, respectively. Therefore, the volume of the entire bucket is greatly reduced, when compared to the traditional mop heads.

When the cleaning and drying operation is completed, the mop head is taken down from the transmission shaft 2. The switch component 6 moves upward to its original position due to the elastic member 61, to unblock the water intake 57 of the water spray mechanism 5, to supply water for the next operation.

Figure 12:
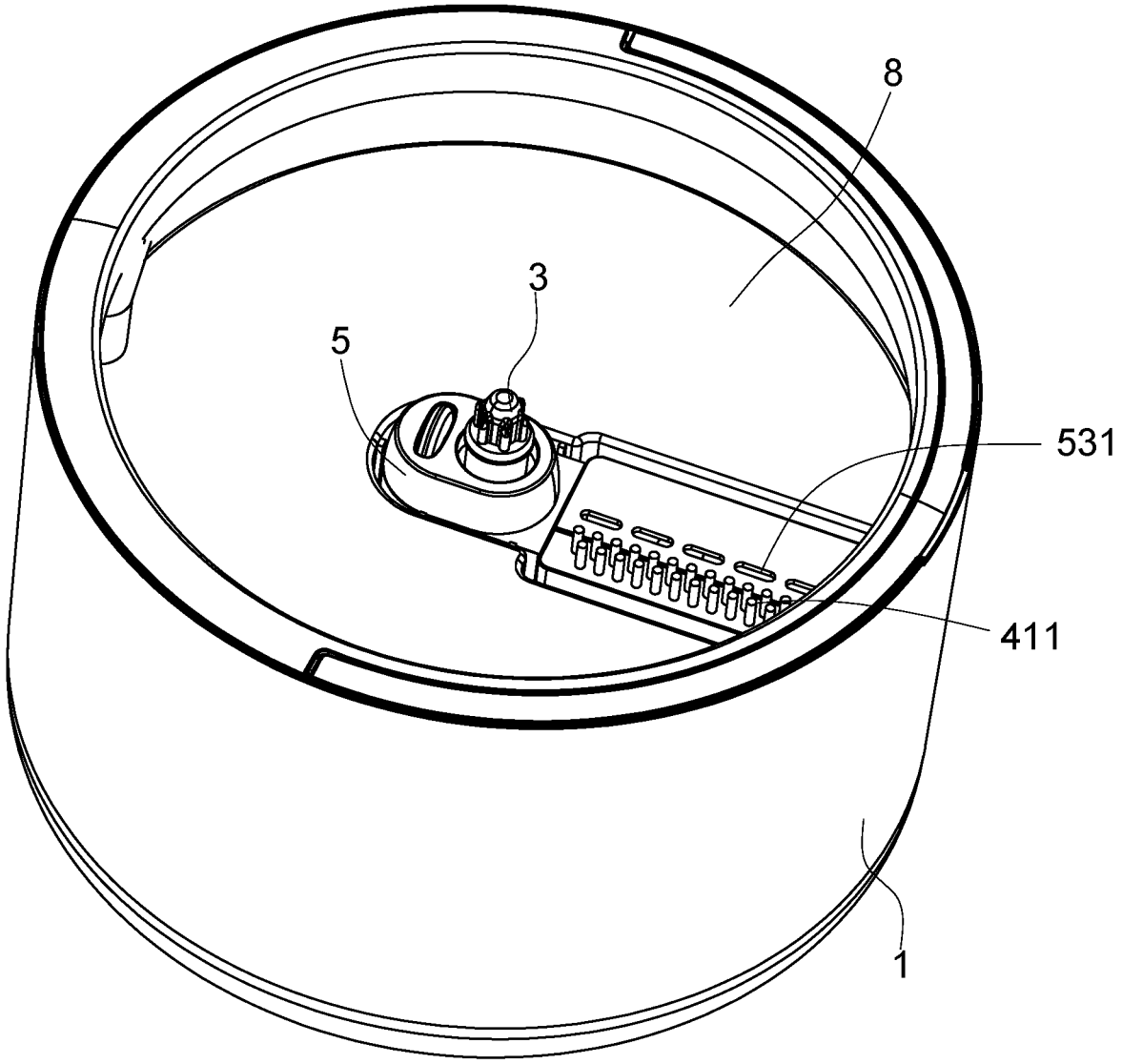
FIG. 12 is a perspective view of the cleaning tool with the mop removed according to a second embodiment of the present invention.
Figure 13:
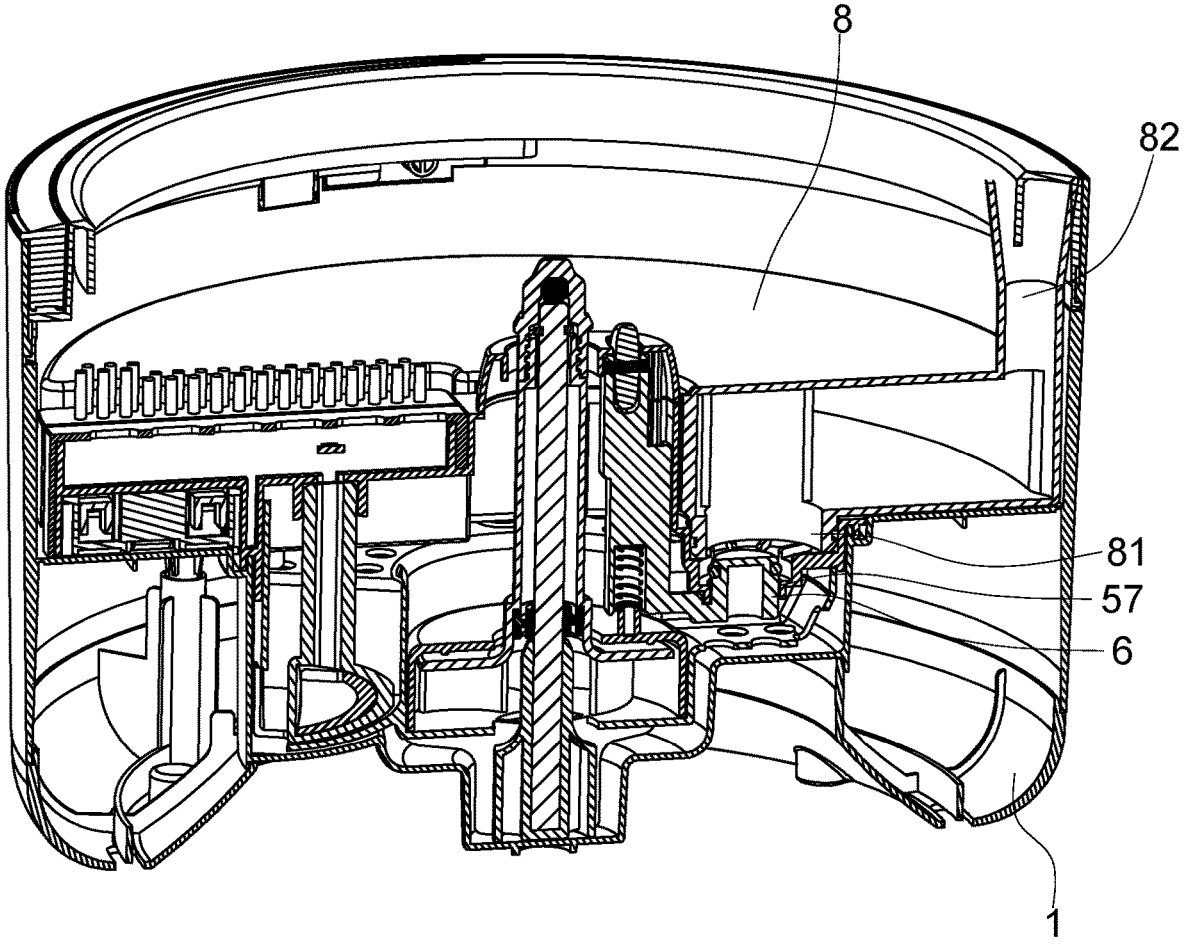
FIG. 13 is an exploded view of the cleaning tool with the mop removed according to the second embodiment.

FIG. 12 to FIG. 13 show a second embodiment of the present invention.

This embodiment differs from the first embodiment in that, a detachable water tank 8 is mounted on the bucket 1, the water tank has a water outlet 81 and a water inlet 82, the water outlet 81 is sealed against the water intake 57 of the water spray mechanism 5. The working principle and process of this embodiment are the same as those of the first embodiment.

It is to be noted that, in the description of this embodiment, orientations or location relationships indicated by terms such as "front, behind", "left, right", "upper, lower" are the orientations and location relationships illustrated on the basis of the accompany drawings. Such terms are used just for ease of describing the present invention and simplifying the description, and it is not indicated or implied that the stated device or element must have a specific orientation or must be constructed and operated in the specific orientation, and shall not be interpreted as any limitation to the present invention. Terms "mounted", "connected to" and "connected with" should be understood in a broad sense. For example, the connection may be fixed connection or detachable connection or integral connection. The connection may be direct connection, or indirect connection with a mediator therebetween. The connection may be the communication between two elements. For a person of ordinary skill in the art, the specific meaning of the aforementioned terms in the present invention can be understood in specific circumstances.

The invention claimed is:

1. A cleaning tool with a spin-drying bucket, comprising a hand-operated rotary mop and a bucket;

wherein, the hand-operated rotary mop comprises an upper rod and a lower rod disposed in a nested arrangement, the upper rod extends telescopically from the lower rod, and the lower rod rotates relative to the upper rod, a driver disposed between the upper rod and the lower rod converts a telescopic motion of the upper rod into a rotary motion of the lower rod;

the lower rod has a mop head with a wiper disposed at a bottom of the lower rod;

a transmission shaft, used for connecting to the mop head, is disposed in the bucket;

a water spray mechanism having a squeezing component for spraying water to the wiper, is disposed in the bucket;

when the mop head is connected to the transmission shaft, the rotation of the lower rod drives the transmission shaft, the mop head, and the squeezing component of the water spray mechanism to rotate together around a same axis and/or at a same speed;

a control member controls a water intake speed of a water intake of the water spray mechanism, so as to make the water intake speed lower than a water spray speed of the water spray mechanism;

wherein the control member is a switch mechanism which is capable of blocking or unblocking the water spray mechanism; when the switch mechanism is closed, the water supply to the water spray mechanism is deactivated or reduced, so as to ensure the amount of water sprayed to the wiper by the water spray mechanism gradually decreases.

2. The cleaning tool of claim 1, wherein the water spray mechanism is controlled by the control member, which adjusts the amount of water sprayed onto the wiper by the water spray mechanism.

3. The cleaning tool of claim 1, wherein the squeezing component is an impeller driven to rotate by the transmission shaft.

4. The cleaning tool of claim 1, wherein a cleaning component used for cleaning the wiper on the bottom of the mop head rotating in the bucket, is disposed in the bucket.

5. The cleaning tool of claim 4, wherein the cleaning component is a bristle holder with bristles, and the bristles are capable of scraping and brushing the rotating wiper to clean the wiper;

the water spray mechanism has a housing, the lower portion of the bristle holder is swingably disposed on the housing, and an elastic mechanism is disposed between the bristle holder and the housing making the bristle holder to move upward to ensure contact between the bristles and the wiper;

or, the water spray mechanism has a housing, the bristle holder is floatably disposed in the housing, and an elastic mechanism is disposed between the bristle holder and the housing making the bristle holder to move upward to ensure the sufficient contact between the bristles and the wiper.

6. The cleaning tool of claim 1, wherein the switch mechanism comprises a switch component extended into the housing of the water spray mechanism and movable up and down, and an elastic member disposed inside the housing resisting against the switch component to make the switch component moving upward;

the switch component is disposed beside the transmission shaft;

when the mop head is connected to the transmission shaft, the switch component moves downward under pressure from the mop head, accordingly, the bottom of the switch component blocks the water intake of the water spray mechanism; and when the mop head is separated from the transmission shaft, the switch component moves upward by the elastic member and the bottom of the switch component unblocks the water intake of the water spray mechanism.

7. The cleaning tool of claim 1, wherein a circular contact component rolling against the wiper disposed on the top of the switch mechanism.

8. The cleaning tool of claim 1, wherein the bucket has a chamber at the bottom inside the bucket, the housing of the water spray mechanism is detachably disposed in the chamber.

9. The cleaning tool of claim 8, wherein a rotary lock mechanism is disposed between the housing and the chamber; when the housing rotates along the rotation direction of the mop head, the housing locks with the chamber, and when the housing rotates along a direction reverse to the rotation direction of the mop head, the housing unlocks with and the chamber.

10. The cleaning tool of claim 9, wherein the housing of the water spray mechanism consists of an upper housing and a lower housing connecting with each other forming a chamber inside the housing, the lower housing has multiple water drainage holes;

a cover is disposed inside the lower housing covering the squeezing component of the water spray mechanism, the inner space of the cover is communicated with the chamber of the housing;

the cover has a water passage at the periphery of the cover, and the housing has a transverse water outlet passage at the top of the housing which communicated with the water passage, several water spray holes are formed on the wall of the water outlet passage which face the wiper on the mop head.

11. The cleaning tool of claim 10, wherein the water outlet passage has an inlet at the bottom of the water outlet passage, a pipe is disposed between the inlet and the water passage, and a baffle located above the inlet is disposed inside the water outlet passage.

12. The cleaning tool of claim 10, wherein a water delivery groove and a water drainage groove both opening upward are formed on the top of the upper housing, a top cap covering the top of the water delivery groove and the water drainage groove is disposed on the upper housing, the space between the water delivery groove and the top cap forms the water outlet passage, and the water spray holes are formed on the top cap, the water drainage groove is communicated with the chamber of the water spray mechanism.

13. The cleaning tool of claim 1, wherein the control member is a filter component disposed at the water intake of the water spray mechanism, or a lid with small pores, which is disposed at the water intake of the water spray mechanism.

14. The cleaning tool of claim 1, wherein a detachable water tank is mounted on the bucket, the water tank has a water outlet and a water inlet, the water outlet is sealed against the water intake of the water spray mechanism.

15. The cleaning tool of claim 1, wherein the squeezing component is an impeller, and an impeller shaft extending out of the housing of the water spray mechanism from the upper portion of the impeller; a fixed shaft is disposed in the housing of the water spray mechanism, the transmission shaft is sleeved at the top of the fixed shaft, and the impeller shaft is sleeved on the fixed shaft through a bearing, the transmission shaft is connected to the impeller shaft.

16. The cleaning tool of claim 15, wherein a rolling member is disposed on the top of the fixed shaft, so as to support the transmission shaft and the mop head connected to the transmission shaft.

17. The cleaning tool of claim 5, wherein the bristle holder is located on a side of the transmission shaft and arranged from the center to the outside of the housing, the bristles have an inner end close to the transmission shaft in the radial direction and an outer end away from the transmission shaft in the radial direction, and the height ($h_1$) of the top surface of the outer end of the bristles is higher than the height ($h_2$) of the top surface of the inner end of the bristles.

18. The cleaning tool of claim 13, wherein a recess is formed on the housing of the water spray mechanism, the water intake runs through the bottom of the recess, and the filter component is disposed inside the recess and can be taken out from the recess.

19. The cleaning tool of claim 17, wherein several spacers protrudes from the annular bottom surface of the recess, distributed in the radial direction and along on the circumference at intervals, a water flow channel communicated with the water intake is formed between two adjacent spacers, and the filter component is placed on the spacers.

20. A cleaning tool with a spin-drying bucket, comprising a hand-operated rotary mop and a bucket;

wherein, the hand-operated rotary mop comprises an upper rod and a lower rod disposed in a nested arrangement, the upper rod extends telescopically from the lower rod, and the lower rod rotates relative to the upper rod;

a driver disposed between the upper rod and the lower rod converts a telescopic motion of the upper rod into a rotary motion of the lower rod;

the lower rod has a mop head with a wiper disposed at a bottom of the lower rod;

a transmission shaft, used for connecting to the mop head, is disposed in the bucket;

a water spray mechanism having a squeezing component for spraying water to the wiper, is disposed in the bucket;

when the mop head is connected to the transmission shaft, the rotation of the lower rod drives the transmission shaft, the mop head, and the squeezing component of the water spray mechanism to rotate together;

the water spray mechanism is controlled by a control member that adjusts the amount of water sprayed onto the wiper by the water spray mechanism, the control member controls the water intake speed of a water intake of the water spray mechanism, so as to make the water intake speed lower than the water spray speed of the water spray mechanism;

the control member is a switch mechanism which is capable of blocking or unblocking the water spray mechanism; when the switch mechanism is closed, the water supply to the water spray mechanism is deactivated or reduced, so as to ensure the amount of water sprayed to the wiper by the water spray mechanism gradually decreases.

21. The cleaning tool of claim 20, wherein the control member is a filter component disposed at the water intake of the water spray mechanism, or a lid with small pores, which is disposed at the water intake of the water spray mechanism.

* * * * *